US007730638B2

(12) United States Patent
Urbach et al.

(10) Patent No.: US 7,730,638 B2
(45) Date of Patent: Jun. 8, 2010

(54) HEEL PROTECTOR

(75) Inventors: Stacie A. Urbach, 211 E. 89th St., Apt. 1A, New York, NY (US) 10128; David Conroy, Brooklyn, NY (US)

(73) Assignee: Stacie A. Urbach, New York, NY (US)

( * ) Notice: Subject to any disclaimer, the term of this patent is extended or adjusted under 35 U.S.C. 154(b) by 811 days.

(21) Appl. No.: 11/655,457

(22) Filed: Jan. 19, 2007

(65) Prior Publication Data

US 2007/0163149 A1 Jul. 19, 2007

Related U.S. Application Data

(60) Provisional application No. 60/760,278, filed on Jan. 19, 2006.

(51) Int. Cl.
*A43B 23/20* (2006.01)

(52) U.S. Cl. ..... 36/72 B; 36/72 R

(58) Field of Classification Search ..... 36/72 R, 36/72 B

See application file for complete search history.

(56) References Cited

U.S. PATENT DOCUMENTS

| | | | | | |
|---|---|---|---|---|---|
| 1,345,875 | A | * | 7/1920 | Peters | 36/72 B |
| 1,841,027 | A | | 1/1932 | Gruber | |
| 1,964,049 | A | * | 6/1934 | Giannini et al. | 36/72 B |
| RE19,543 | E | * | 4/1935 | Winget | 36/72 B |
| 2,109,193 | A | * | 2/1938 | Field et al. | 36/72 B |
| 2,552,096 | A | * | 5/1951 | Johnson | 36/70 R |
| 3,122,848 | A | * | 3/1964 | Grossman | 36/7.3 |
| 3,150,453 | A | * | 9/1964 | Tilden | 36/72 B |
| 3,439,435 | A | * | 4/1969 | Fredon | 36/72 R |
| 4,461,100 | A | * | 7/1984 | Minor et al. | 36/72 B |
| 4,727,659 | A | * | 3/1988 | Walker | 36/72 B |
| 5,044,097 | A | * | 9/1991 | Young | 36/72 B |
| 5,357,694 | A | | 10/1994 | Mauck | |

FOREIGN PATENT DOCUMENTS

| | | | |
|---|---|---|---|
| GB | 2 190 823 | A | 12/1987 |
| GB | 2 195 228 | A | 4/1988 |
| GB | 2 214 053 | A | 8/1989 |
| GB | 2 217 177 | A | 10/1989 |

OTHER PUBLICATIONS

International Search Report, for international application No. PCT/US2007/001805, dated May 8, 2007.

* cited by examiner

*Primary Examiner*—Marie Patterson
(74) *Attorney, Agent, or Firm*—RatnerPrestia

(57) ABSTRACT

A heel protector is disclosed. The heel protector includes a stem portion having a body and at least one retaining portion. A channel is formed between the body and the at least one retaining portion. A biasing portion extends from the stem portion. The biasing portion includes an opening therein. A leaf portion extends from the biasing portion. A shoe and heel protector assembly is also disclosed. A method of using the heel protector to protect the heel and waist of a shoe is also disclosed.

36 Claims, 4 Drawing Sheets

HEEL PROTECTOR

CROSS-REFERENCE TO RELATED APPLICATION

The present application claims priority from U.S. Provisional Patent Application Ser. No. 60/760,278, filed on Jan. 19, 2006.

FIELD OF THE INVENTION

This invention relates generally to shoes with heels and more specifically to a cover for protecting the heel and waist of a woman's shoe.

BACKGROUND OF THE INVENTION

The heels on most women's footwear are generally made of hard plastic or wooden blocks called "heel blocks," that can be covered with various materials called "heel covers." Heel covers may include materials such as leather, suede, stacked leather, and fabric. These thin soft heel covers are often merely glued to heel blocks, are very fragile, and tend to damage easily. There are a variety of causes of damage to heel covers including, but not limited to, catching the back of the heel on a curb, escalator, or leg of a chair; getting into and out of a car; driving a car; walking down stairs; etc. The most destructive form of damage often occurs when the heel slips into the crack or grate of a sidewalk.

Some heel blocks are constructed of solid wood, which is then polished. Damaging these types of heels is akin to damaging a fine piece of furniture, where only refinishing can restore the original luster of the design. Other heel blocks may be finished with a metallic or painted type covering. These finishes are extremely fragile during wear and any damage to the finishes would be difficult to repair at a shoe repair shop.

When shoes are worn outside, especially on city sidewalks, the top lifts (plastic or rubber bottom pieces of the heel) wear down extremely quickly. If these are not replaced in time, the heel cover, along with the heel block, can be damaged.

Further, when sitting on a stool or a raised chair with a foot bar, women tend to hook the heel over the bar, such that the waist of the shoe rests on the bar. On lighter colored soles, the bar can leave dirt and marks. This causes more of a problem with many of today's high end shoes which have signature sole colors that extend all the way to the waist and even the heel breast. This problem may also occur, albeit at a lower occurrence, simply by walking up stairs.

Also, heel covers, especially those made of fabric, can sustain substantial damage in the form of discoloration when exposed to various elements such as water, snow, rain or puddles. Additionally, women may tip-toe around, or even limit where they walk, when attending a garden party, for example, for fear of their heels being ruined by slipping into the lawn.

SUMMARY OF THE INVENTION

Briefly, the present invention provides a heel protector comprising a stem portion having a body and at least one retaining portion. A channel is formed between the body and the at least one retaining portion. A biasing portion extends from the stem portion. The biasing portion includes an opening therein. A leaf portion extends from the biasing portion.

In an additional embodiment, the present invention also provides a shoe and heel protector assembly comprising a shoe having a heel and a waist disposed forward of the heel.

The assembly also includes a heel protector. The heel protector comprises a stem portion having a body and at least one retaining portion. A channel is formed between the body and the at least one retaining portion. A biasing portion extends from the stem portion. The biasing portion includes an opening therein. A leaf portion extends from the biasing portion. The heel extends through the opening and into the channel such that the heel urges the at least one retaining portion away from the channel.

In another embodiment, the present invention provides a method of retaining a heel protector on a shoe heel comprising the step of providing a heel protector comprising a stem portion having a body and at least one retaining portion. A channel is formed between the body and the at least one retaining portion. A biasing portion extends from the stem portion. The biasing portion includes an opening therein. A leaf portion extends from the biasing portion. The method further comprises the steps of providing a shoe comprising a heel and a waist disposed forward of the heel, inserting the heel through the opening and inserting the heel into the channel such that the leaf portion engages the waist.

In still another embodiment, the present invention also provides a method of protecting a heel and a waist of a shoe. The method comprises the step of providing a heel protector. The heel protector includes a stem portion having a body and at least one retaining portion. A channel is formed between the body and the at least one retaining portion. A biasing portion extends from the stem portion. The biasing portion includes an opening therein. A leaf portion extends from the biasing portion. The method further comprises the steps of providing a shoe comprising a heel and a waist disposed forward of the heel and inserting the heel protector over the heel such that the stem portion protects the heel and the leaf portion protects the waist.

In still another embodiment, the present invention provides a method of resisting rotation of a heel protector about a heel on which the heel protector is fitted. The method comprises the step of providing a heel protector. The heel protector includes a stem portion having a body and at least one retaining portion, and a channel formed between the body and the at least one retaining portion. A biasing portion extends from the stem portion and includes an opening therein. A leaf portion extends from the biasing portion and includes at least one leaf tip extending from the leaf portion, away from the biasing portion. The method further comprises the steps of providing a shoe comprising a heel and a waist disposed forward of the heel and fitting the heel protector over the heel with the stem portion protecting the heel and the at least one leaf tip engaging the waist such that the at least one leaf tip frictionally engages the waist.

In still another embodiment, the present invention also provides a method of indicating wear on a heel tip. The method comprises the step of providing a heel protector. The heel protector includes a stem portion having a body, at least one retaining portion, a channel formed between the body and the at least one retaining portion, and a top lift tab extending away from the body. A biasing portion extends from the stem portion. The biasing portion includes an opening therein. A leaf portion extends from the biasing portion. The method further comprises the steps of providing a shoe comprising a heel and a top lift extending away from the heel, fitting the heel protector over the heel such that the top lift tab is flush with the top lift, and correlating wear of the top lift tab with wear of the top lift.

BRIEF DESCRIPTION OF THE DRAWINGS

The foregoing summary, as well as the following detailed description of an exemplary embodiment of the invention, will be better understood when read in conjunction with the appended drawings, which are incorporated herein and constitute part of this specification. For the purposes of illustrating the invention, there are shown in the drawings an exemplary embodiment. It should be understood, however, that the invention is not limited to the precise arrangements and instrumentalities shown. In the drawings, which are not drawn to scale, the same reference numerals are employed for designating the same elements throughout the several figures. In the drawings.

DETAILED DESCRIPTION OF THE INVENTION

Certain terminology is used herein for convenience only and is not to be taken as a limitation on the present invention. The terminology includes the words specifically mentioned, derivatives thereof and words of similar import. As used herein, the term "front" is defined to mean a direction closer to the toe portion of a shoe and "rear" is defined to mean a direction closer to the heel portion of a shoe. Preferred features of an embodiment of this invention will now be described with reference to the figures. It will be appreciated that the spirit and scope of the invention is not limited to the embodiment selected for illustration. Also, it should be noted that the drawings are not rendered to any particular scale or proportion. It is contemplated that any of the configurations and materials described hereafter can be modified within the scope of this invention.

Referring to the figures in general, a heel protector 100 according to an exemplary embodiment of the present invention is shown. Heel protector 100 is easily slipped onto a heel 60 of a shoe 50 in order to reduce the risk of damage to the heel 60 and/or the waist 64 that extends forward of heel 60. Heel protector 100 is also easily removable from heel 60 in order to show off heel 60 in an environment where heel 60 is less likely to be damaged.

Figure 1:
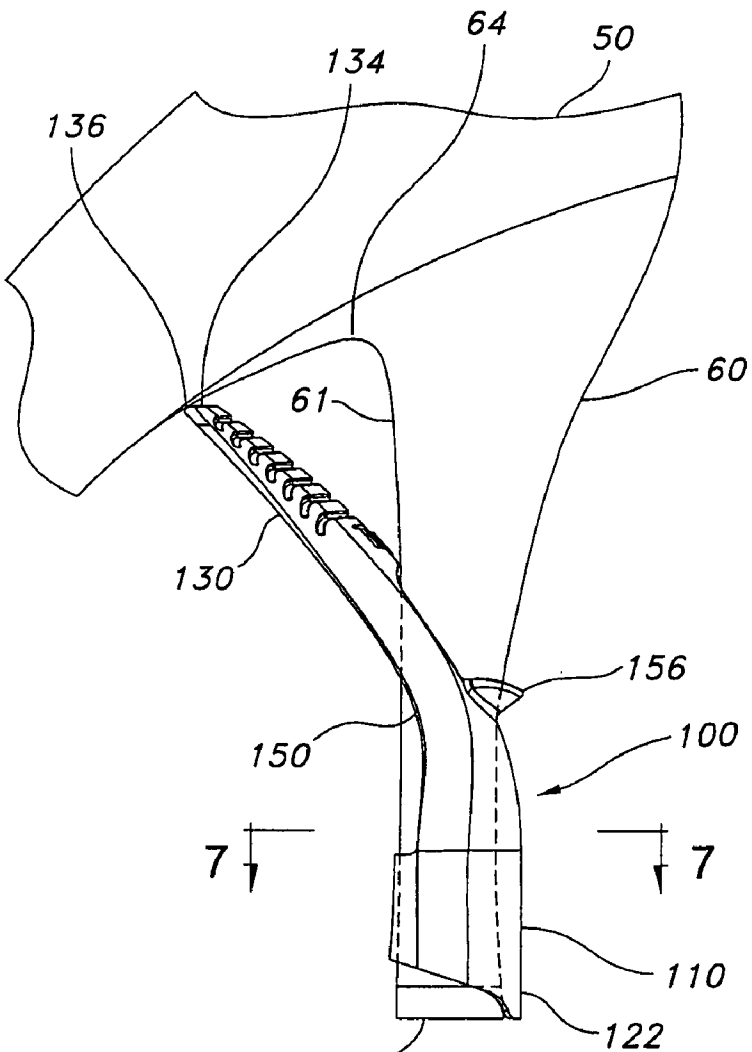
FIG. 1 is a side profile view of a shoe with a heel protector according to a preferred embodiment of the present invention.

Referring now specifically to FIGS. 1-4, an exemplary embodiment of heel protector 100 according to the present invention is shown. In FIG. 1, heel protector 100 is shown on shoe 50 having heel 60. Heel protector 100 is a single piece that can be constructed of polypropylene or some other suitable, flexible, yet strong and durable material. Heel protector 100 can be manufactured by injection molding. Also, in an alternative exemplary embodiment, heel protector 100 is transparent so as not to detract from the appearance of heel 60. Alternatively, heel protector 100 may be colored, decorated, and/or include embellishments, such as rhinestones, to intentionally allow the wearer the ability to change the look of heel 60.

Figure 2:
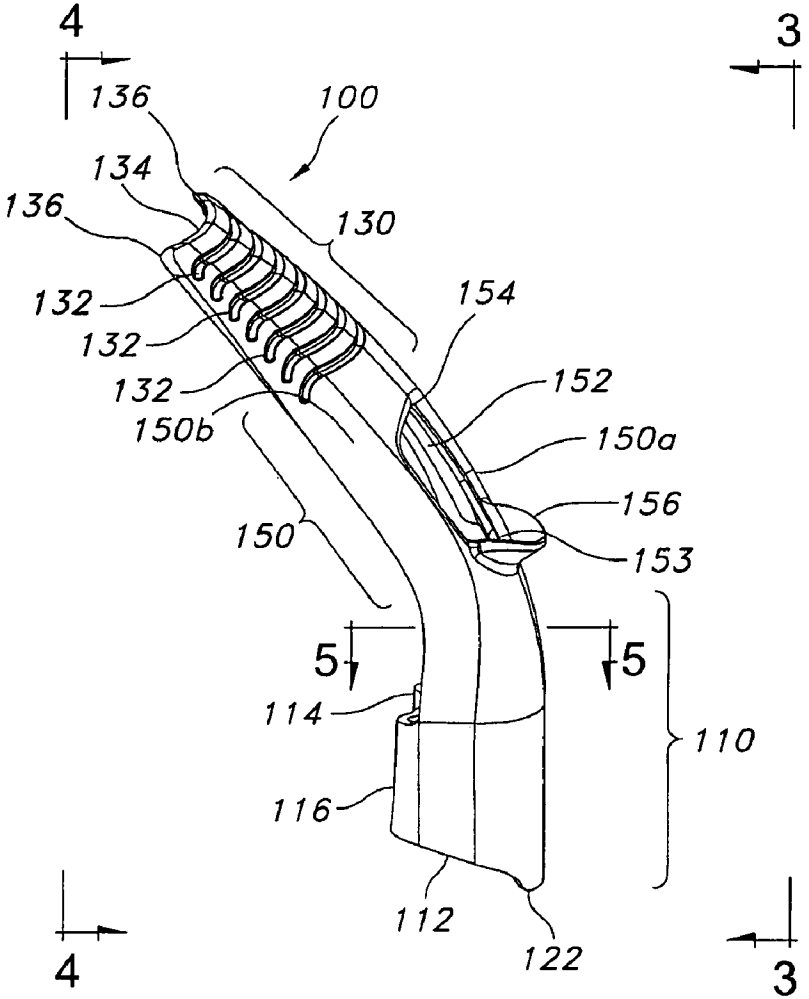
FIG. 2 is a perspective view of the heel protector shown in FIG. 1.

Referring to FIG. 2, heel protector 100 includes a stem portion 110, a biasing portion 150 that extends from stem portion 110, and a leaf portion 130 that angularly extends from biasing portion 150, such that biasing portion 150 is disposed between stem portion 110 and leaf portion 130.

Figure 6:
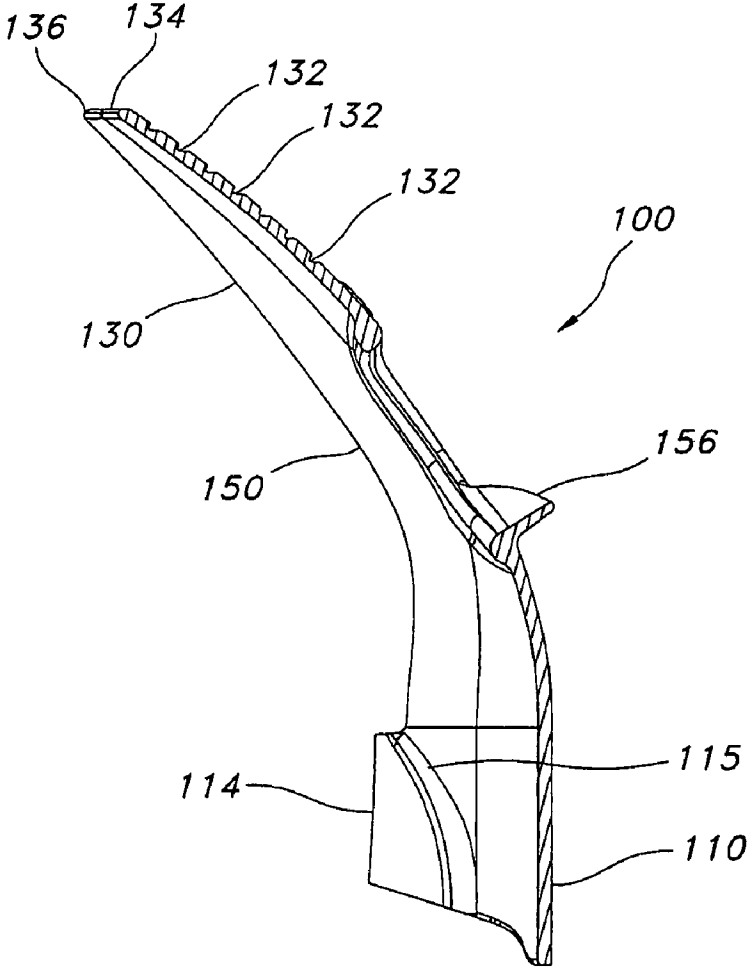
FIG. 6 is a side profile view, in section, of the heel protector taken along lines 6-6 of FIG. 3.
Figure 5:
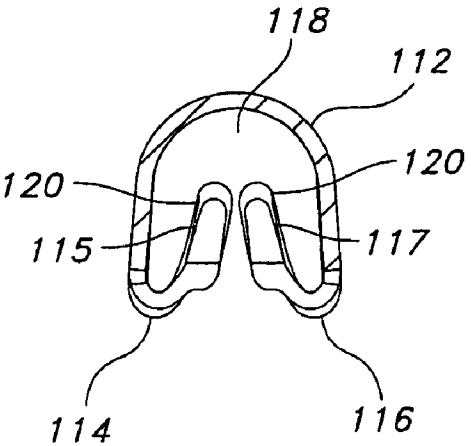
FIG. 5 is a top plan view, in section, of the heel protector taken along lines 5-5 of FIG. 2.

Stem portion 110 includes a body 112 having a generally curved cross section, as shown in FIG. 5. The curvature of body 112 mates with the curved rear portion of a typical heel, such as heel 60. A retaining portion in the form of clamps retain heel protector 100 on heel 60. A first clamp 114 extends from one side of body 112 while a second clamp 116 extends from a second side of body 112. Clamps 114, 116 each include a chamfered face 115, 117, respectively, with only chamfered face 115 being shown in FIG. 6. As can be seen from FIG. 5, body 112 and clamps 114, 116 define a channel 118 into which a heel, such as heel 60 (shown in FIG. 7), is inserted. Chamfered faces 115, 117 facilitate insertion of heel 60 into channel 118.

Figure 7:
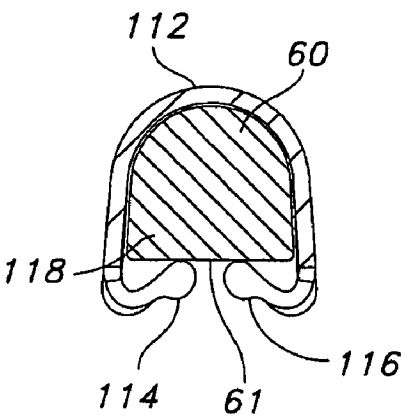
FIG. 7 is a is a top plan view, in section, of the heel protector taken along lines 7-7 of FIG. 1.

Also in an exemplary embodiment, free ends of clamps 114, 116 each include a rounded surface 120 in order to not scratch or otherwise mar heel 60 during use. Each clamp 114, 116 is generally "U-shaped" and, in an unbiased condition, such as when heel 60 is not inserted into channel 118, clamps 114, 116 are disposed toward each other. In a biased condition, such as when heel 60 is inserted into channel 118 as shown in FIG. 7, a heel breast 61 of heel 60 urges free ends of clamps 114, 116 away from each other. The resilient nature of the material from which heel protector 100 is constructed allows clamps 114, 116 to bias heel 60 against body 112 so that heel protector 100 is retained on heel 60.

Referring back to FIG. 2, a top lift tab 122 may extend downward from body 112 distal from clamps 114, 116. Referring to FIG. 1, with heel protector 100 inserted onto heel 60, top lift tab 122 is flush with the bottom of top lift 62, and therefore, flush with the ground during use. Top lift tab 122 discourages heel protector 100 from riding down heel 60 since top lift tab 122 is flush with the ground. If top lift tab 122 is the first point of contact with an edge of a crack, the force against top lift tab 122 will try to push heel protector 100 up heel 60. This force, however, will also cause leaf 130 to push up against waist 64 of shoe 50, minimizing any travel of protector 100 up heel 60.

Wear of top lift tab 122 may be correlated with wear of top lift 62 and provide an indication to the wearer that top lift 62 is also being worn. Such indication alerts the wearer to obtain a replacement top lift. While top lift tab 122 is shown in FIG. 1 as extending only along the rear portion of body 112 in an exemplary embodiment, those skilled in the art will recognize that top lift tab 122 may extend forward and extend from clamps 114, 116 as well.

Referring back to FIG. 2, leaf portion 130 is shown as a generally elongated piece. Leaf portion 130 extends away from stem portion 110 at an angle of approximately 50 degrees, although those skilled in the art will recognize that other angles are contemplated. In the exemplary embodiment shown, a plurality of scribe lines 132 are formed on leaf portion 130, and extend laterally across leaf portion 130. Scribe lines 132 enable the wearer to easily cut leaf portion 130 to a desired length to conform with the particular shoe 50 that heel protector 100 is being used. A free end 134 of leaf portion 130 includes leaf tips 136.

As shown in FIG. 1, leaf tips 136 of leaf portion 130 engage waist 64 of shoe 50, forward of heel 60. Note that only one leaf tip 136 is shown in FIG. 1. Naturally, heel protector 100 wants to ride up on heel 60. A properly trimmed leaf portion 130 bears up against waist 64 of shoe 50, creating an upper limit and thus restricting heel protector 100 from riding up on heel 60. Together, leaf portion 130 and top lift tab 122 keep heel protector 100 generally in place on heel 60. Leaf tips 136 also frictionally engage waist 64 of shoe 50, resisting rotation of heel protector 100 relative to heel 60.

Biasing portion 150 extends between stem portion 110 and leaf portion 130. Biasing portion 150 structurally holds the angle formed between leaf portion 130 and stem portion 110. When heel protector 100 is placed on heel 60, the angle is changed, with biasing portion 150 fighting to maintain the angle. The result is a "clamp" action that is a mechanism for maintaining heel protector 100 in place during use.

Figure 4:
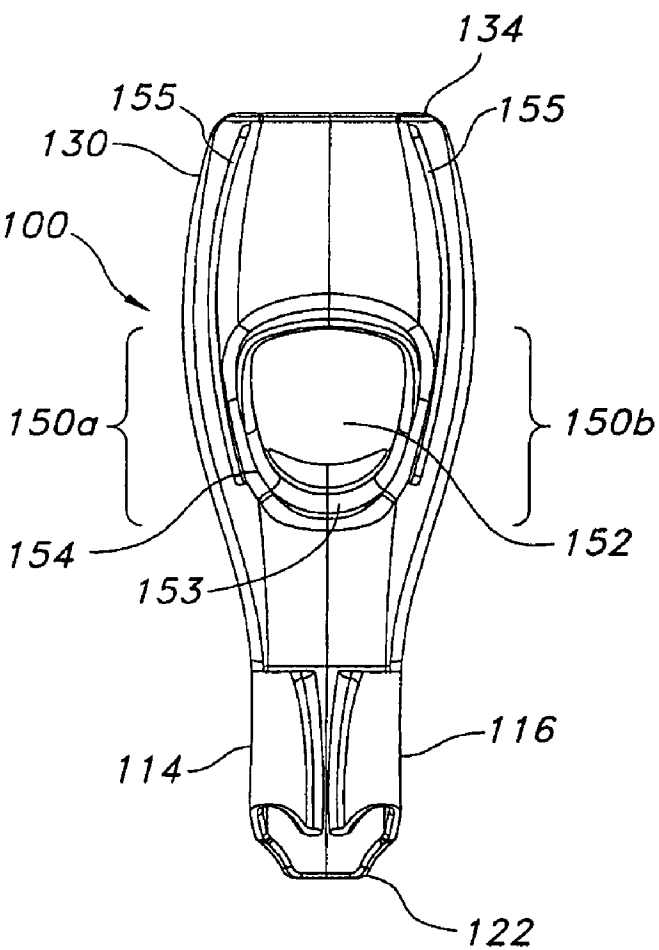
FIG. 4 is a front profile view of the heel protector taken along lines 4-4 of FIG. 2
Figure 3:
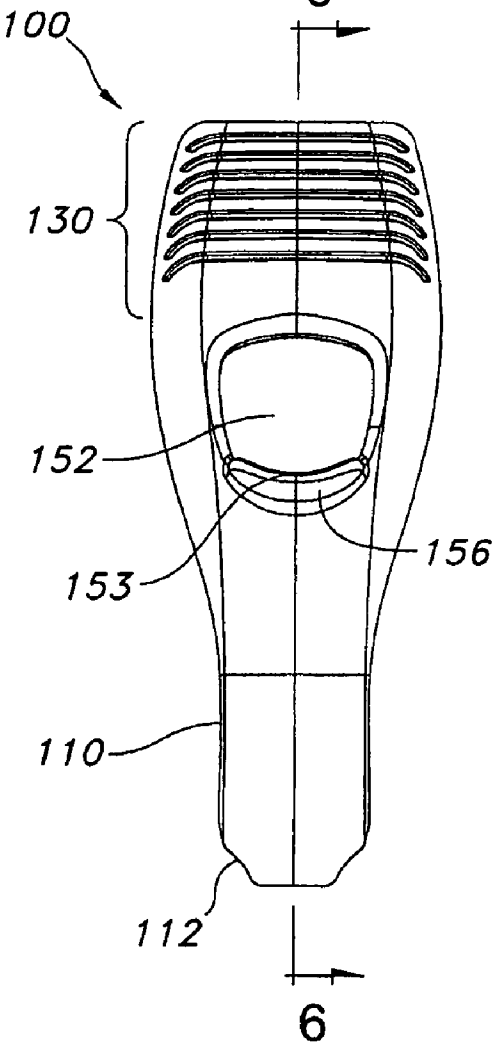
FIG. 3 is a rear profile view of the heel protector taken along lines 3-3 of FIG. 2.

Referring to FIG. 4, biasing portion 150 includes biasing segments 150*a*, 150*b*. An opening 152 is formed in biasing portion 150 between biasing segments 150*a*, 150*b* to accommodate insertion of heel 60 therethrough. Opening 152 is slightly offset from channel 118 (not shown in FIG. 4) to generate a flex and clamp action, but still facilitate insertion of heel 60 through opening 152 and into channel 118. While opening 152 is shown in FIGS. 3 and 4 as a generally "D-shaped" opening, those skilled in the art will recognize that opening 152 may have alternate shapes, such as, for example, round. Rounded portion 153 of opening 152 corresponds with the rounded rear portion of exemplary heel 60.

In an exemplary embodiment shown in FIG. 4, a rounded rib 154 extends along the underside of opening 152. Rounded rib 154 prevents heel protector 100 from scratching heel 60 when heel protector 100 is being attached to or removed from heel 60. Rib 154 may be molded with heel protector 100 during manufacture. Alternatively, rounded rib 154 may be constructed from a separate rubber coating that is added after manufacture of heel protector 100 or co-injected with heel protector 100. A pair of longitudinal reinforcing ribs 155 optionally extend on either side of opening 152 along biasing portion 150 and leaf portion 130. Reinforcing ribs 155 may be used instead of or in addition to rib 154. Reinforcing ribs 155 provide additional strength to leaf portion 130 and biasing portion 150 to maintain flexibility of heel protector 100. A reinforcing rib 155 may also be used, alone or in combination with rib 154.

Optionally, as shown in FIGS. 1 and 2, a tang 156 may extend rearward from the top of stem portion 110 at the interface between stem portion 110 and biasing portion 150. Tang 156 minimizes damage to the upper portion of heel 60 which is not covered by the heel protector in the event that the wearer slips into a grate or a large crack.

Figure 8:
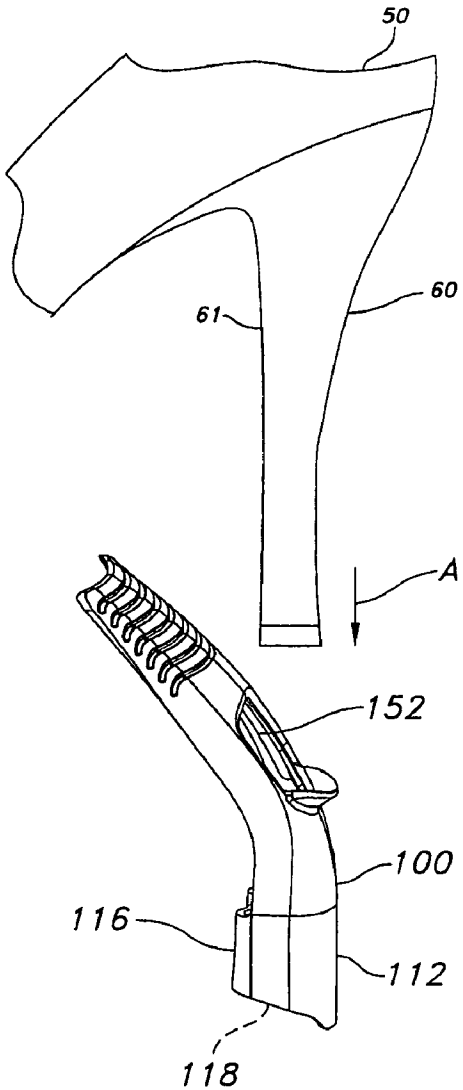
FIG. 8 side profile view of a heel of the shoe of FIG. 1 being inserted into the heel protector of FIG. 1.

To use heel protector 100, the wearer inserts heel 60 of shoe 50 into opening 152 as shown by arrow "A" in FIG. 8. Heel 60 is advanced to clamps 114, 116. With a slight push, heel 60 is slid into channel 118 between clamps 114, 116 and stem body 112. Chamfers 115, 117 (shown in FIG. 5) assist in directing heel 60 into channel 118. Clamps 114, 116 are urged away from each other by advancing heel 60. Clamps 114, 116 in return urge heel 60 against body 112 of stem portion 110 so that clamps 114, 116 and body 112 grip heel 60, as shown in FIG. 7.

Heel 60 is further advanced until top lift tab 122 is flush with top lift 62, as shown in FIG. 1. Leaf tips 136 at free end 134 of leaf portion 130 engage waist 64 and are biased against waist 64. Biasing portion 150 bends relative to stem portion 110 such that the angle between leaf portion 130 and stem portion 110 is between about 50 degrees and about 90 degrees. The biasing action of leaf portion 130 against waist 64 discourages stem portion 110 from riding up heel 60 and resists rotation of heel protector 100 about heel 60 during use. Heel protector 100 engages shoe 50 in channel 118 and in line contact with clamps 114, 116, as shown in FIG. 1, in line contact with at least forward and rear portions of rib 154, and in point contact with at least one leaf tip 136, as shown in FIG. 1. The various contact locations with shoe 50 throughout the length of heel protector 100 help heel protector 100 to resist rotation about heel 60 from a force against heel protector 100 that may otherwise induce rotation about heel 60.

While FIG. 7 shows a heel 60 having a generally "D" shaped cross section inserted into channel 118, those skilled in the art will recognize that heels of other cross sections may be inserted into channel 118. Such heels will engage body 112 of stem portion 110 in at least one location around body 112 between clamps 114, 116.

If leaf portion 130 is too long for the particular shoe 50 on which heel protector 100 is being used, prior to heel protector 100 being inserted onto shoe 50, leaf portion 130 may be cut, preferably along one of scribe lines 132. Scribe lines 132 are curved to mimic the line of free end 134 of leaf portion 130. This ensures that leaf tips 136 on free end 134 of leaf 130 make contact with waist 64.

With heel 60 fully inserted into heel protector 100, the portion of the heel cover that tends to be exposed to the most damage and waist 64 are both protected from excess damage. An additional benefit to heel protector 100 is that heel protector 100 may be retained on heel 60 when shoe 50 is not being worn.

Preferably, the insertion of, and removal of, heel protector 100 over heel 60 may be performed using only one hand. This insertion and removal may be performed while shoe 60 is either being worn or not worn. To remove heel protector 100, the wearer can grasp heel protector 100 by stem portion 110 or biasing portion 150 and force heel protector 100 downward so that heel 60 slides through channel 118 and opening 152.

An advantage of heel protector 100 is that, due to the flexible nature of clamps 114, 116 to secure heel 60 in the channel 118, heel protector 100 may be used with different size and style heels within a range of sizes and styles. For example, it is envisioned that one size of heel protector 100 may be used for shoes having higher, thin heels over approximately 2¾" (about 7 cm) in height, which include stiletto heels, high Spanish heels, post heels, higher thin Louis heels and derivatives of these heel types; a second size heel protector 100 may be used for shoes having lower thin heels, between approximately 1½" (about 3.8 cm) and 2¾" (about 7 cm) in height, which include Spanish heels, lower spike heels, lower post heels, lower thin Louis heels, and derivatives of these heel types; a third size heel protector 100 may be used for shoes having heels that are wider than the typical Spanish or stiletto heel, but narrower than a typical block heel and over approximately 2" (about 5.1 cm) in height, including a Louis heel; and a fourth size heel protector 100 that may be used for shoes having kitten heels, low post heels, and derivatives of these heel types. Those skilled in the art will also recognize that a custom sized heel protector 100 may be used as well. Additionally, in addition to being used with shoes having hind quarters, heel protector 100 can be used with backless sandals that do not include hind quarters.

Further, heel protector 100 may be used multiple times on multiple different shoes without changing the fit of any of the shoes on which heel protector 100 is worn. However, individual users may desire to maintain one set of heel protectors with a particular pair of shoes, particularly if leaf portion 130 is trimmed for a particular shoe design.

As discussed above, the structure and contact of heel protector 100 with various locations on shoe 50 aid in resisting rotation of heel protector 100 about heel 60 in the event that a force is applied that may otherwise induce rotation of heel protector 100 about heel 60.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A heel protector comprising:

a stem portion having a body including at least one retaining portion, and a channel formed between the body and the at least one retaining portion;

a biasing portion extending from the stem portion, the biasing portion including an opening therein; and a leaf portion extending from the biasing portion.

2. The heel protector according to claim 1, wherein the body has a first side and a second side, and the at least one retaining portion comprises a first clamp extending from the first side of the body and a second clamp extending from the second side of the body.

3. The heel protector according to claim 2, wherein, in an unbiased condition, the first and second clamps are adapted to be disposed toward each other and, in a biased condition, the first and second clamps are adapted to be disposed away from each other.

4. The heel protector according to claim 2, wherein each of the first and second clamps is comprised of a generally "U-shaped" cross section.

5. The heel protector according to claim 1, wherein the body is comprised of a generally curved portion.

6. The heel protector according to claim 1, wherein the leaf portion comprises a plurality of generally parallel scribe lines extending laterally across the leaf portion.

7. The heel protector according to claim 1, wherein the opening comprises a generally "D" shape.

8. The heel protector according to claim 1, further comprising a rounded rib surrounding the opening.

9. The heel protector according to claim 1, further comprising an interface between the stem portion and the opening, and a tang extending from the stem portion at the interface.

10. The heel protector according to claim 1, further comprising a top lift tab extending from the stem portion distal of the at least one retaining portion.

11. The heel protector according to claim 1, further comprising at least one rib extending longitudinally along the biasing portion and the leaf portion.

12. The heel protector according to claim 1, wherein the at least one retaining portion comprises a plurality of retaining portions.

13. A shoe and heel protector assembly comprising:

a heel protector comprising:

a stem portion having a body including at least one retaining portion, and a channel formed between the body and the at least one retaining portion;

a biasing portion extending from the stem portion, the biasing portion including an opening therein; and a leaf portion extending from the biasing portion, and a shoe having a heel and a waist disposed forward of the heel and the heel extending through the opening and into the channel such that the heel urges the at least one retaining portion away from the channel.

14. The shoe and heel protector assembly according to claim 13, wherein the leaf has a free end biased against the waist.

15. The shoe and heel protector according to claim 13, wherein body has a first side and a second side, and the at least one retaining portion comprises a first clamp extending from the first side and a second clamp extending from the second side.

16. The shoe and heel protector according to claim 15, wherein the clamps are biased against the heel.

17. The shoe and heel protector according to claim 15, wherein, in an unbiased condition, the first and second clamps are disposed toward each other and, in a biased condition, the first and second clamps are disposed away from each other.

18. The shoe and heel protector according to claim 15, wherein each of the first and second clamps is comprised of a generally "U-shaped" cross section.

19. The shoe and heel protector assembly according to claim 15, wherein the body is comprised of a generally curved portion.

20. The shoe and heel protector assembly according to claim 13, wherein the leaf portion comprises a plurality of generally parallel scribe lines extending across a lateral direction of the leaf portion.

21. The shoe and heel protector assembly according to claim 13, wherein the opening comprises a generally "D" shape.

22. The shoe and heel protector assembly according to claim 13, further comprising a rounded rib surrounding the opening.

23. The shoe and heel protector assembly according to claim 13, further comprising an interface between the stem portion and the opening, and a tang extending from the stem portion at the interface.

24. The shoe and heel protector assembly according to claim 13, further comprising a top lift tab extending from the stem portion distal of the at least one retaining portion.

25. The shoe and heel protector assembly according to claim 13, further comprising at least one rib extending longitudinally along the biasing portion and the leaf portion.

26. The shoe and heel protector assembly according to claim 13, wherein the at least one retaining portion comprises a plurality of retaining portions.

27. The shoe and heel protector assembly according to claim 13, wherein the leaf portion engages the waist and the biasing portion engages the heel.

28. The shoe and heel protector assembly according to claim 13, wherein the shoe does not have a hind quarter.

29. A method of retaining a heel protector on a shoe heel comprising the steps of:

providing a shoe comprising a heel and a waist disposed forward of the heel;

providing a heel protector comprising:

a stem portion having a body and at least one retaining portion, and a channel formed between the body and the at least one retaining portion;

a biasing portion extending from the stem portion, the biasing portion including an opening therein; and a leaf portion extending from the biasing portion;

inserting the heel through the opening; and inserting the heel into the channel such that the leaf portion engages the waist.

30. The method according to claim 29, wherein the step of inserting the heel into the channel comprises the at least one retaining portion biasing the heel against the body.

31. The method according to claim 29, wherein the step of inserting the heel into the channel such that the leaf portion engages the waist comprises biasing the leaf against the waist.

32. The method according to claim 29, wherein the step of inserting the heel through the opening comprises restricting rotation of the heel with respect to the opening.

33. The method according to claim 29, wherein the leaf further comprises a plurality of generally parallel scribe lines extending across a lateral direction of the leaf portion and wherein the method further comprises, prior to the step of inserting the heel into the opening, cutting the leaf along one of the scribe lines.

34. A method of protecting a heel and a waist of a shoe comprising the steps of:

providing a heel protector comprising:

a stem portion having a body and at least one retaining portion, and a channel formed between the body and the at least one retaining portion;

a biasing portion extending from the stem portion, the biasing portion including an opening therein; and a leaf portion extending from the biasing portion;

providing a shoe comprising a heel and a waist disposed forward of the heel; and fitting the heel protector over the heel with the stem portion protecting the heel and the leaf portion protecting the waist.

35. A method of resisting rotation of a heel protector about a heel on which the heel protector is fitted, comprising the steps of:

providing a heel protector comprising:

a stem portion having a body and at least one retaining portion, and a channel formed between the body and the at least one retaining portion;

a biasing portion extending from the stem portion, the biasing portion including an opening therein; and a leaf portion extending from the biasing portion, the leaf portion including at least one leaf tip extending from the leaf portion, away from the biasing portion;

providing a shoe comprising a heel and a waist disposed forward of the heel; and fitting the heel protector over the heel with the stem portion protecting the heel and the at least one leaf tip engaging the waist, the at least one leaf tip frictionally engaging the waist.

36. A method of indicating wear on a heel tip comprising the steps of:

providing a heel protector comprising:

a stem portion having:

a body;

at least one retaining portion;

a channel formed between the body and the at least one retaining portion; and a top lift tab extending away from the body;

a biasing portion extending from the stem portion, the biasing portion including an opening therein; and a leaf portion extending from the biasing portion;

providing a shoe comprising a heel and a top lift extending away from the heel;

fitting the heel protector over the heel such that the top lift tab is flush with the top lift; and correlating wear of the top lift tab with wear of the top lift.

* * * * *